US011470900B1

(12) United States Patent
Lindquist

(10) Patent No.: US 11,470,900 B1
(45) Date of Patent: Oct. 18, 2022

(54) GARMENT COVER FOR AN ADJUSTMENT FIT ATTACHMENT

(71) Applicant: Wrangler Apparel Corp., Greensboro, NC (US)

(72) Inventor: John Lindquist, Liberty, NC (US)

(73) Assignee: Wrangler Apparel Corp., Greensboro, NC (US)

( * ) Notice: Subject to any disclaimer, the term of this patent is extended or adjusted under 35 U.S.C. 154(b) by 0 days.

(21) Appl. No.: 16/536,724

(22) Filed: Aug. 9, 2019

Related U.S. Application Data

(60) Provisional application No. 62/764,703, filed on Aug. 15, 2018.

(51) Int. Cl.
*A41F 9/02* (2006.01)
*A41D 1/06* (2006.01)

(52) U.S. Cl.
CPC ..... *A41F 9/025* (2013.01); *A41D 1/06* (2013.01)

(58) Field of Classification Search
CPC ..... A41F 9/02; A41F 9/025; A41D 1/06
USPC ..... 2/237, 219, 220, 235, 221, 236
See application file for complete search history.

(56) References Cited

U.S. PATENT DOCUMENTS 275,441 A * 4/1883 Wahl ..... A41F 9/02 2/237
486,894 A * 11/1892 Rachelman ..... A41F 9/02 2/237
625,423 A 5/1899 Scriven
873,389 A * 12/1907 Stanford ..... A41F 9/002 2/339
907,593 A * 12/1908 Greenwald ..... A41F 9/02 2/237
1,149,271 A * 8/1915 Lazarus ..... A41F 9/02 2/237
1,174,976 A * 3/1916 Gaines ..... A41D 1/21 2/221
1,185,914 A * 6/1916 Klein ..... A41F 9/02 2/237
1,231,025 A * 6/1917 Inghram ..... A41F 9/02 2/237
1,453,243 A * 4/1923 Eichhorn ..... A41F 9/02 2/235
1,506,255 A * 8/1924 Rosenstein ..... A41F 9/025 2/236

(Continued)

FOREIGN PATENT DOCUMENTS

BE 1004613 A6 * 12/1992 ..... A41F 9/025
CH 250639 A * 9/1947 ..... A41F 9/025

(Continued)

OTHER PUBLICATIONS

Office Action for U.S. Appl. No. 16/536,792, dated Jan. 19, 2021, 23 pgs.

(Continued)

*Primary Examiner* — Khoa D Huynh
*Assistant Examiner* — Grace Huang
(74) *Attorney, Agent, or Firm* — Womble Bond Dickinson (US) LLP

(57) ABSTRACT

A garment cover for an adjustment fit bottom including apparatus, systems, and methods including an adjustment fit band secured by an adjustment fit attachment along the adjustment fit band. The adjustment fit attachment may be covered by a garment cover.

19 Claims, 12 Drawing Sheets

(56) References Cited

U.S. PATENT DOCUMENTS 1,826,803 A * 10/1931 Lubell ..... A41F 9/02 2/237
2,063,886 A * 12/1936 Alexandre ..... A41F 9/025 2/237
2,085,913 A * 7/1937 Lipton ..... A41F 9/02 2/237
2,087,357 A * 7/1937 Persson ..... A41F 9/025 2/237
2,104,287 A * 1/1938 Beck ..... A41F 9/02 2/320
2,137,396 A 11/1938 Gladstone
2,198,738 A * 4/1940 Pintus ..... A41F 9/025 2/237
2,319,138 A * 5/1943 Kneibler ..... A41B 9/02 2/234
2,376,589 A * 5/1945 Fink ..... A41F 9/025 2/235
2,493,813 A * 1/1950 Greenblatt et al. ..... A41F 9/02 2/237
2,525,060 A * 10/1950 Axler ..... A41F 9/02 2/221
2,581,627 A * 1/1952 Bubb ..... A41F 9/025 2/237
2,583,992 A * 1/1952 Boutelcoup ..... A41F 9/025 2/237
2,628,928 A * 2/1953 Cadous ..... B32B 27/12 442/183
2,668,957 A * 2/1954 Schmidt ..... A41F 19/00 2/227
2,721,330 A * 10/1955 Axler ..... A41F 9/02 2/237
2,847,677 A 8/1958 Robertson
3,341,862 A * 9/1967 Wiesner ..... A41F 9/025 2/221
3,445,862 A * 5/1969 Parsont ..... A41D 1/06 2/237
3,590,390 A * 7/1971 Howard ..... A41B 11/126 2/312
3,760,426 A * 9/1973 Jacob ..... A41F 9/02 2/237
3,812,541 A 5/1974 Stuart
4,089,068 A * 5/1978 Swallow ..... A41D 13/1209 2/221
4,164,044 A 8/1979 Holms
4,244,199 A * 1/1981 Rhode ..... D04B 21/18 66/193
4,287,611 A 9/1981 Lundstrom
4,551,994 A * 11/1985 Vailati ..... A41F 9/02 66/190
4,580,298 A 4/1986 Tuisl
4,620,326 A * 11/1986 Matthias, Jr. ..... A41F 9/025 2/221
5,033,125 A 7/1991 De La Villefromoy et al.
5,283,910 A * 2/1994 Flint ..... A41F 9/025 2/221
5,575,010 A 11/1996 Chung
5,954,564 A * 9/1999 Ganz ..... A41C 1/003 450/99
6,520,832 B2 * 2/2003 Devita ..... A41F 1/006 2/251
D495,972 S 9/2004 Pettingill
7,631,369 B2 * 12/2009 Geiwald ..... A41B 9/02 2/400
D613,479 S 4/2010 Farmer
D614,379 S 4/2010 Campbell
8,122,520 B2 * 2/2012 Wilson, II ..... A41F 9/025 2/237
8,429,762 B2 * 4/2013 Weisman ..... A41D 7/005 2/67
D683,521 S 6/2013 Garcia
8,474,065 B2 * 7/2013 Kingsbury ..... F16B 47/00 2/221
D693,992 S 11/2013 Dinunzio
9,125,440 B1 9/2015 Guerrero
D754,948 S 5/2016 Cockram
D783,939 S 4/2017 Scott
10,004,281 B2 6/2018 Rowe
D825,148 S 8/2018 Horning
2008/0040833 A1 * 2/2008 Kato ..... A41F 9/025 2/112
2008/0301855 A1 12/2008 Ball
2008/0313790 A1 * 12/2008 Miller ..... A41F 9/025 2/338
2011/0131708 A1 * 6/2011 Miller ..... A41F 9/025 2/308
2011/0314593 A1 * 12/2011 Anderson ..... A41B 1/16 2/338
2014/0115755 A1 * 5/2014 Mahar ..... A41F 9/025 2/336
2015/0082509 A1 * 3/2015 Davis ..... A41D 13/02 2/79
2015/0106994 A1 4/2015 Silva
2015/0282545 A1 * 10/2015 Shaw ..... A41F 9/025 2/237
2017/0143057 A1 5/2017 Morris-Wilton
2019/0075861 A1 * 3/2019 Burgess ..... A41F 1/02

FOREIGN PATENT DOCUMENTS

CH 478537 A * 9/1969 ..... A41F 9/025
FR 743568 A * 4/1933 ..... A41F 9/02
FR 1034460 A * 7/1953 ..... A41F 9/025
FR 1470422 A * 2/1967 ..... A41F 9/025
FR 2285821 A1 * 4/1976 ..... A41F 9/025
GB 312005 A * 5/1929 ..... A41F 9/025
GB 423558 A * 2/1935 ..... A41F 9/02
GB 478497 A * 1/1938 ..... A41F 9/025
GB 1208426 A * 10/1970 ..... A41F 9/025

OTHER PUBLICATIONS

Application as filed for U.S. Appl. No. 16/536,792, filed Aug. 9, 2019, 27 pgs.
Application as filed for U.S. Appl. No. 29/651,444, filed Aug. 15, 2018, 10 pgs.
Office Action for U.S. Appl. No. 16/536,792, dated Dec. 22, 2021, 32 pages.

* cited by examiner

Inside View - Right Front

Inside View - Left Front

Inside View - Right Front

Inside View - Left Front

Inside View - Right Front

Inside View - Left Front

Inside View - Right Front

Inside View - Left Front

Inside View - Right Front

Inside View - Left Front

Inside View - Right Front

Inside View - Left Front

Inside View - Left Front

Inside View - Right Front

Inside View - Right Front

Inside View - Left Front

GARMENT COVER FOR AN ADJUSTMENT FIT ATTACHMENT

BACKGROUND

(1) Field

The inventions of the present disclosure relate generally to apparel and, more particularly, to a garment cover for an adjustment fit button adapted to provide improved comfort to the wearer.

(2) Related Art

Pants, jeans by way of example, and the like are a staple garment found in most closets. Many wearers like the look of jeans but desire a more comfortable fit. Over time, the styling and components of some jeanswear/pantswear has changed in various ways to accommodate such consumer demands.

Jeans composed of denim and blends with elastic fibers have become popular sellers because of their comfort and improved styling. Another aspect, for example, in kids and youth garments, has been to add an adjustment fit band and button to make a waistband of the garment sizable as the wearer grows. The adjustability of the band of the garment may make the garment more comfortable in some aspects and prolong the life of the garment for the wearer; however, the button, attachment portion and fit band of the garment typically create an uncomfortable point of contact with the wearer's skin. Applicant realized the attachment point for the fit band may cause discomfort, especially in children.

The adjustment fit band contributes greatly to increasing the lifespan of garments in quickly growing children and those seeking adjustable sizing, however, the discomfort of the adjustable band assembly remained a hindrance to many users, and a good alternative addressing these difficulties is yet to be found.

It is to these and other challenges the inventions of the present disclosure are directed.

SUMMARY

The inventions of the present disclosure are directed to a garment for providing comfort to the wearer in an adjustment fit garment, often a bottom garment. In some embodiments, the garment may include a waistband, and an adjustment fit assembly. The adjustment fit assembly may include an adjustment fit band, an adjustment fit attachment, a set of fit adjustment slots in the adjustment fit band, and a waistband fit band opening. The garment may also include a garment cover for the adjustment fit attachment.

The cover may provide a lining between the adjustment fit attachment and a wearer where the attachment can sometimes become embedded into, make an imprint in, and/or just become uncomfortable on the skin of the wearer and cause discomfort. The cover may provide a cushion between the skin of the wearer and the adjustment fit attachment. The cover may be a cushioning cover.

The cover may be a retractable cover, for example, a retractable fabric such that the cover may be manipulated to be pulled back in a second position to reveal the adjustment fit attachment so that the adjustment assembly may be exposed and adjusted for sizing along the adjustment fit band. The cover may be a durable material that is able to withstand multiple washings and usage, especially in a children's garment. The material may be a fire retardant material.

The cover may be a resilient cover. At least a portion of the cover may be retractable to reveal the adjustment fit attachment in a second position, and after a sizing adjustment is made, the cover, in this example, is resilient, such that the cover returns substantially to a first position, covering the adjustment fit attachment.

In some embodiments, a stretch of the cover is greater in a horizontal direction than in a vertical direction.

In a bottom garment, there may be a front panel and a back panel, and a waistband. In some embodiments, the stretch of the cover in the weft direction of the cover may be greater than a stretch in the weft direction of the garment.

In one embodiment, the cover may be formed of a knitted fabric. The knitted fabric may be a circular knit fabric. The cover may be an elastic cover and/or may include an elastic component.

The garment, by way of example, may include jeans, pants, capris, skirts, shorts, jackets, tops, sweatshirts, headbands, and any garment including an adjustment fit assembly.

Accordingly, one aspect of the inventions of the present disclosure is to provide a bottom garment for providing comfort to the wearer, the garment including a front panel; a back panel. A garment cover may be formed of a high weft-stretch fabric, low weight fabric and attached on the inside of a waistband of the garment.

Some embodiments may be considered a garment having a covering system according to any of the embodiments disclosed herein.

Other embodiments include a garment cover assembly according to any of the embodiments disclosed herein.

Still other examples include, a method for a garment covering an adjustment fit band according to any of the embodiments disclosed herein.

In an embodiment of the present disclosure, a garment for providing comfort to a wearer includes a waistband, an adjustment fit assembly, and a garment cover. The waistband has an inside surface, an upper waist band, and a lower waistband. The inside surface is configured to face the wearer. The adjustment fit assembly includes an adjustment fit band, an adjustment fit attachment, a set of fit adjustment slots in the adjustment fit band, and a waistband fit band opening. The adjustment fit attachment is attached directly to and extends inward from the inside surface of the waistband. The garment cover has a top edge that is attached directly to the inside surface of the waistband or an inside surface of the garment. The garment cover also has a bottom edge that is attached directly to the inside surface of the waistband or an inside surface of the garment.

These and other aspects of the inventions of the present disclosure will become apparent to those skilled in the art after a reading of the following description of the preferred embodiments when considered with the drawings.

DETAILED DESCRIPTION OF EMBODIMENTS

Figure 1:
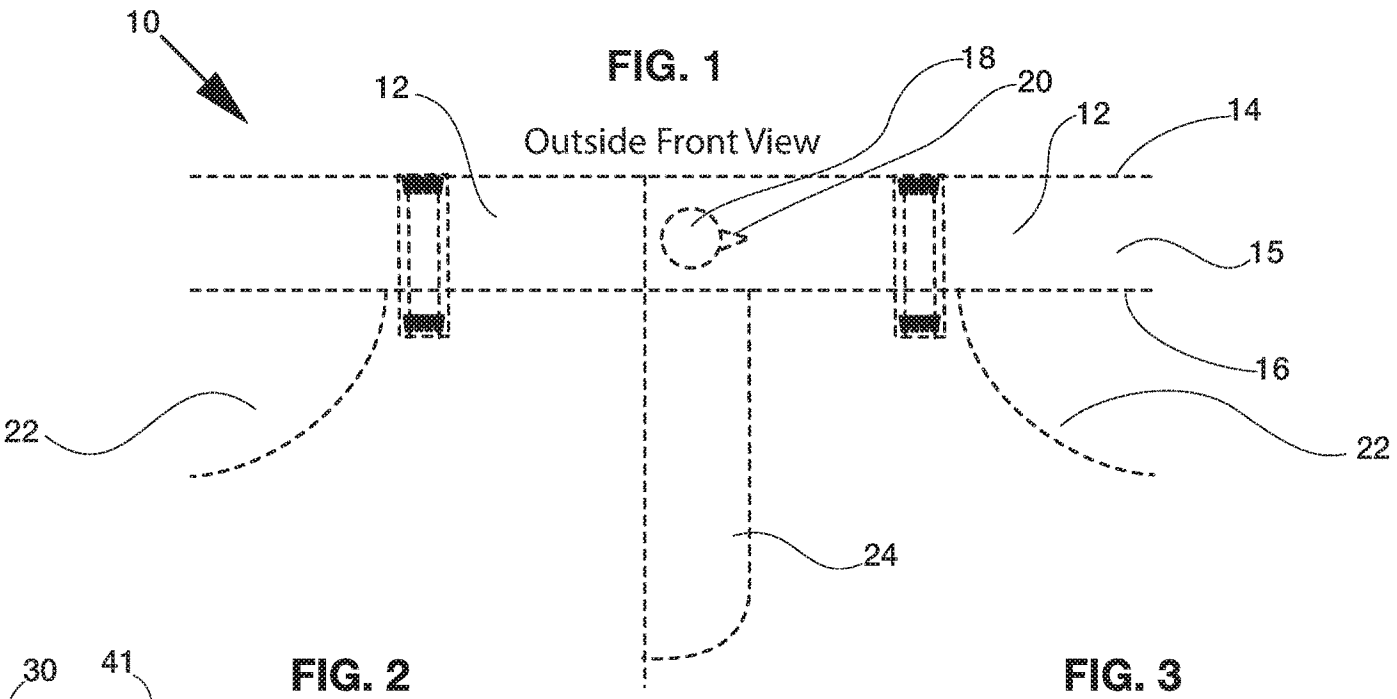
FIG. 1 is a front external view of a garment constructed according to one embodiment of the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
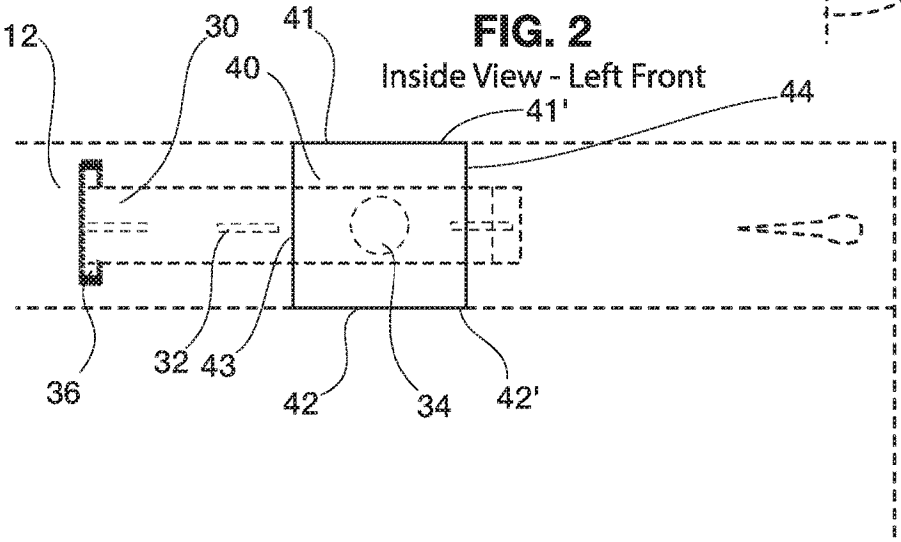
FIG. 2 is a front inside-out inner view of one side of a bottom garment showing a garment cover for adjustment fit attachment according to the present disclosure.
Figure 3:
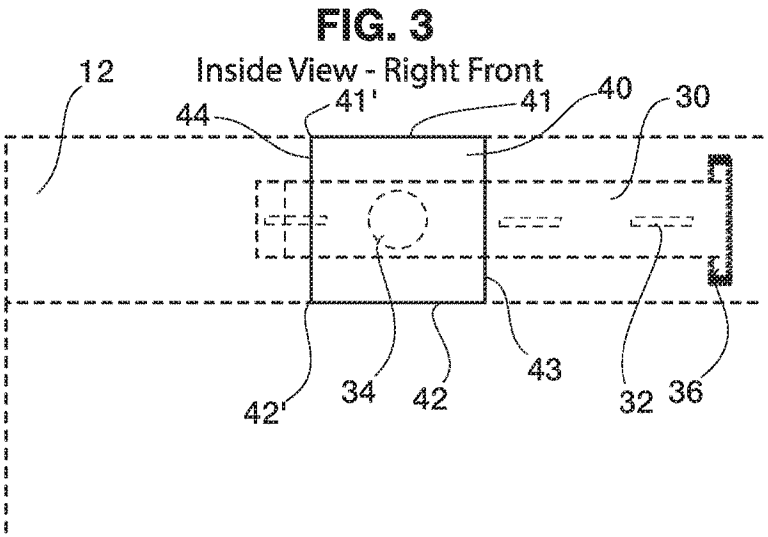
FIG. 3 is a front inside-out inner view of the other side of a bottom garment to FIG. 2, showing a garment cover for adjustment fit attachment.

Referring now to the drawings in general and FIGS. 1-3 in particular, it will be understood that the illustrations are for the purpose of describing preferred embodiments of the inventions and are not intended to limit the inventions thereto. As shown in FIG. 1-3, a garment, generally designated 10, is shown constructed according to the present disclosure. The garment 10 may include a waistband 12 and be configured to provide comfort to the wearer in an adjustment fit garment in an economical manner that does not add excessive additional cost to the garment. The waistband 12 may include a set of waistband sides, a waistband attachment 18 and waistband attachment point 20 where the two sides come together, an upper waistband 14 and a lower waistband 16. The waistband attachment 18 may, by way of example, include a button, a snap, a hook, a Velcro™ attachment, etc.

The garment may also include a fly assembly 24. The fly assembly, by way of example, may include zippers, buttons, hook and loop fasteners, hook and eye snap, string ties, and other conventional fly assemblies.

The garment may include front and back panels. The front and back panels may be formed of a high weft-stretch fabric. The front and back panels may, for example, be a stretch denim fabric for jeans and/or suitable fabrics used for pants, capris, skirts and/or shorts.

The garment 10 may include an adjustment fit assembly, including an adjustment fit band 30, an adjustment fit attachment 34, a set of fit adjustment slots 32 in the adjustment fit band 30, a waistband fit band opening 36. In one example, the waistband fit band opening 36 houses at least a portion of the adjustment fit band 30, the adjustment fit band 30 protruding from an inside portion of the waistband through the waistband fit band opening 36 and exposed along the waistband 12 on an inner side of the garment, the adjustment fit band 30 configured to tighten and loosen the waistband 12 of the garment 10 by being adjusted substantially horizontally along the waistband 12 and secured at an adjustment point by way of the adjustment fit attachment 34.

The garment may include a garment cover 40 for the adjustment fit attachment 34.

The cover 40 may provide a lining between the adjustment fit attachment 34 and a wearer where the adjustment fit attachment 34 can sometimes be irritating to the skin of the wearer and cause discomfort. The cover 40 may provide a cushion between the skin of the wearer and the adjustment fit attachment 34. The cover 40 may be a cushioning cover.

The cover 40 may include a cover top edge or top 41, a cover bottom edge or bottom 42, a cover first side edge or side 43, and a cover second side edge or side 44. FIGS. 2 and 3 show a cover 40 including an attachment point at the upper waistband 14 of the garment 41'. The cover 40 may also include an attachment point at the lower waistband 16 of the garment 42'. The cover first side 43 and second side 44 may remain substantially free and unattached. In other embodiments, cover 40 includes an attachment along at least one side of the cover 40, forming a perpendicular attachment vertically between the upper waistband 14 and the lower waistband 16 across a waistband body 15.

Some examples may include where an exposed portion of the adjustment fit band 30 is covered by the cover 40. The cover 40 may include a first covering position, as seen in FIGS. 2 and 3, and a second retracted position (shown in FIG. 21) in which the cover 40 is configured to be retracted back along one side of the cover 40 to expose the adjustment fit attachment 34.

Figure 5:
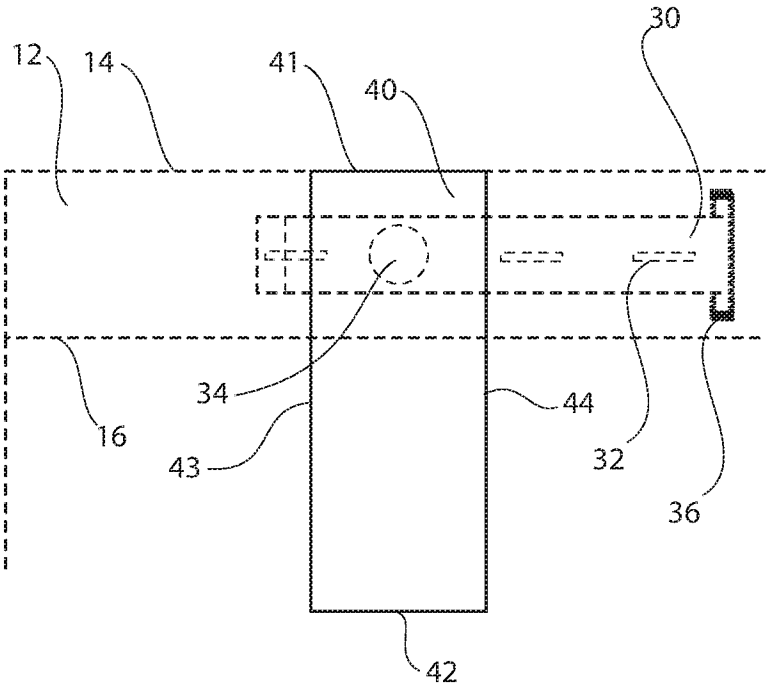
FIG. 5 is another example of a front inside-out inner view of the other side of a bottom garment to FIG. 4, showing a garment cover for adjustment fit attachment.
Figure 4:
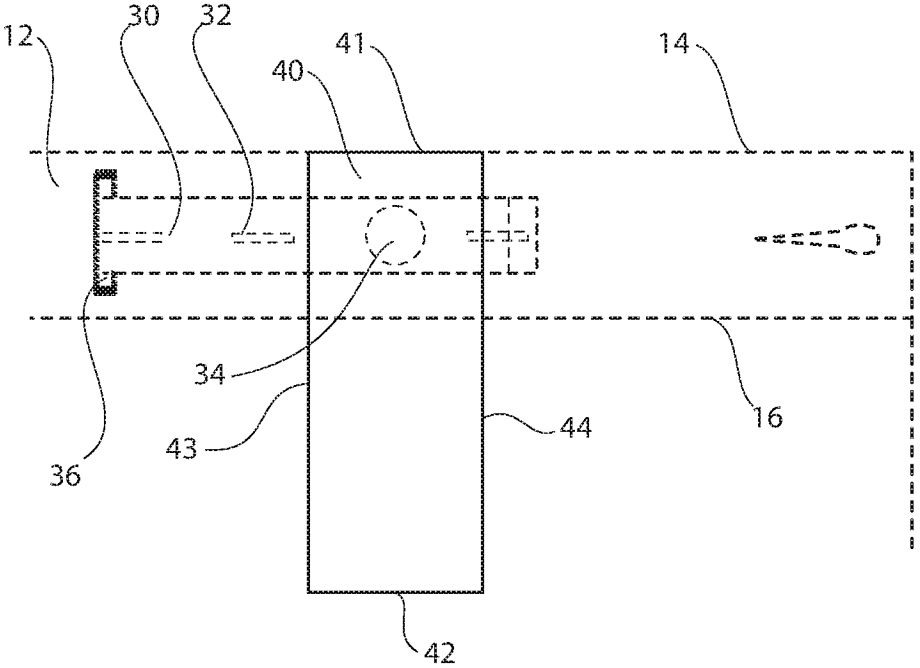
FIG. 4 is another example of front inside-out inner view of one side of a bottom garment showing a garment cover for adjustment fit button according to the present disclosure.
Figure 7:
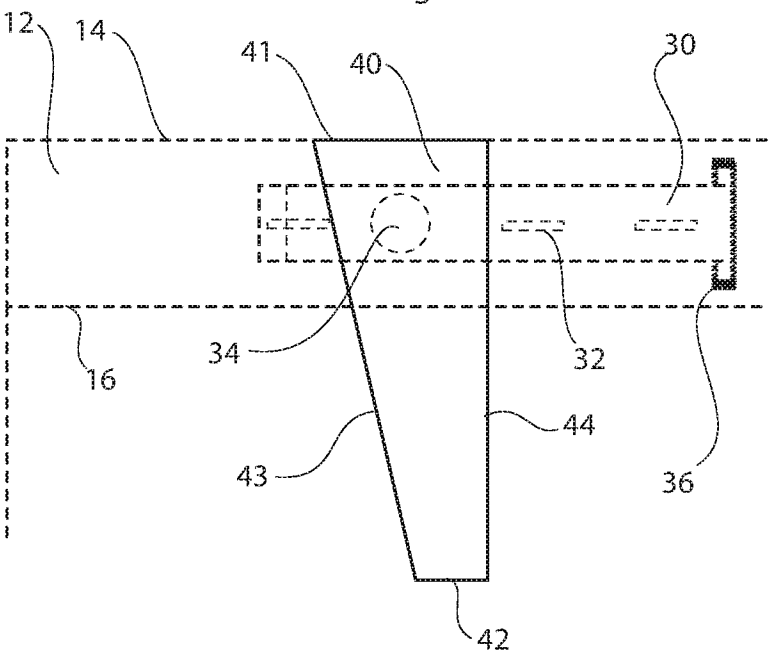
FIG. 7 is another example of a front inside-out inner view of the other side of a bottom garment to FIG. 6, showing a garment cover for adjustment fit attachment.
Figure 6:
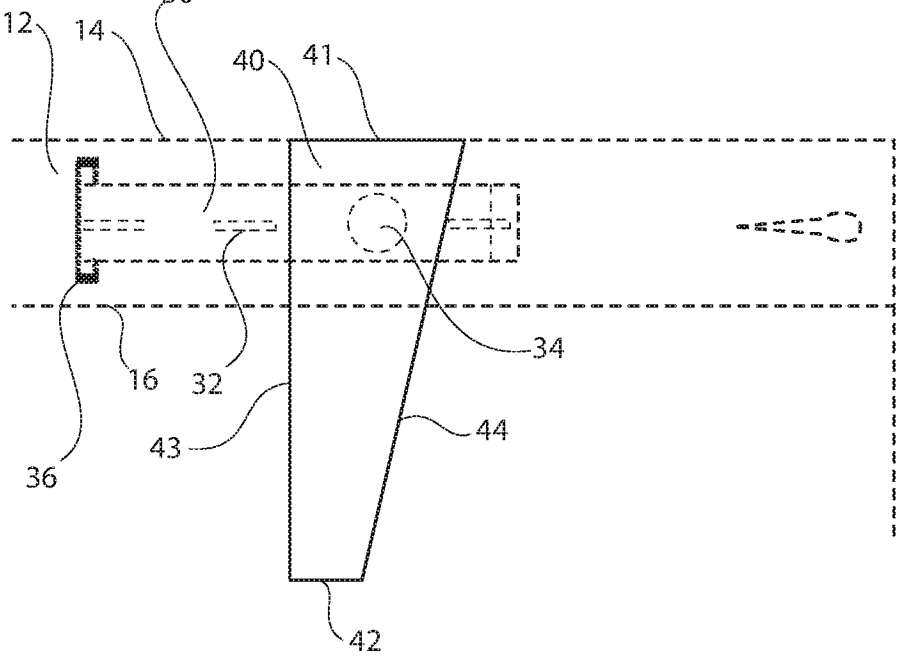
FIG. 6 is another example of front inside-out inner view of one side of a bottom garment showing a garment cover for adjustment fit attachment according to the present disclosure.
Figure 9:
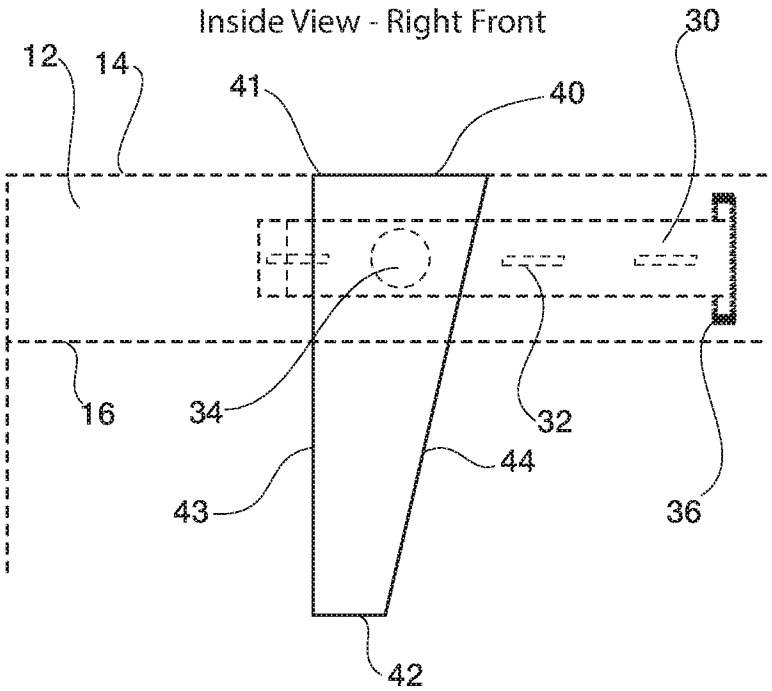
FIG. 9 is another example of a front inside-out inner view of the other side of a bottom garment to FIG. 8, showing a garment cover for adjustment fit attachment.
Figure 8:
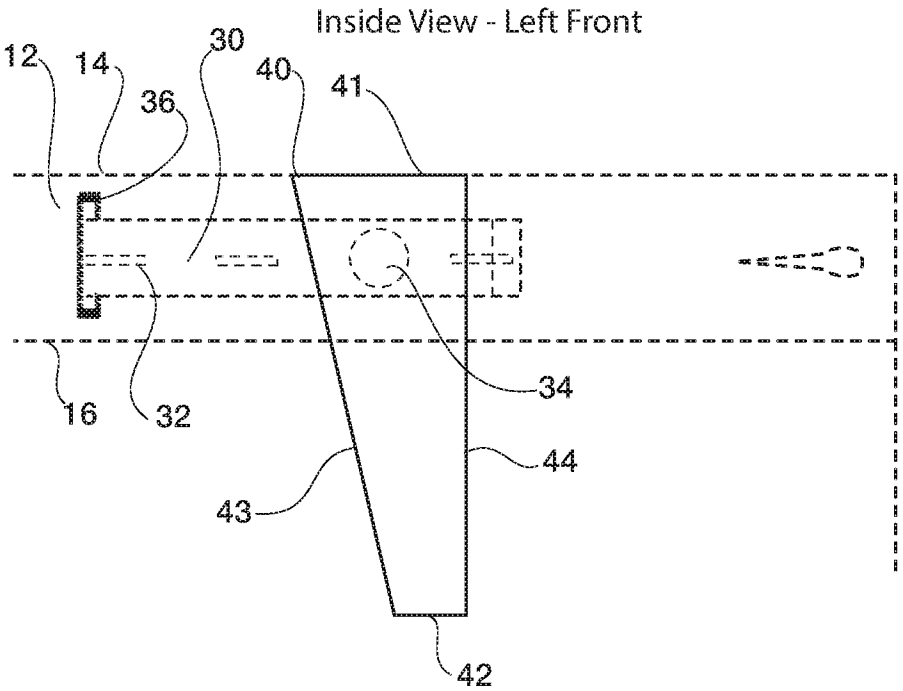
FIG. 8 is another example of front inside-out inner view of one side of a bottom garment showing a garment cover for adjustment fit attachment according to the present disclosure.
Figure 11:
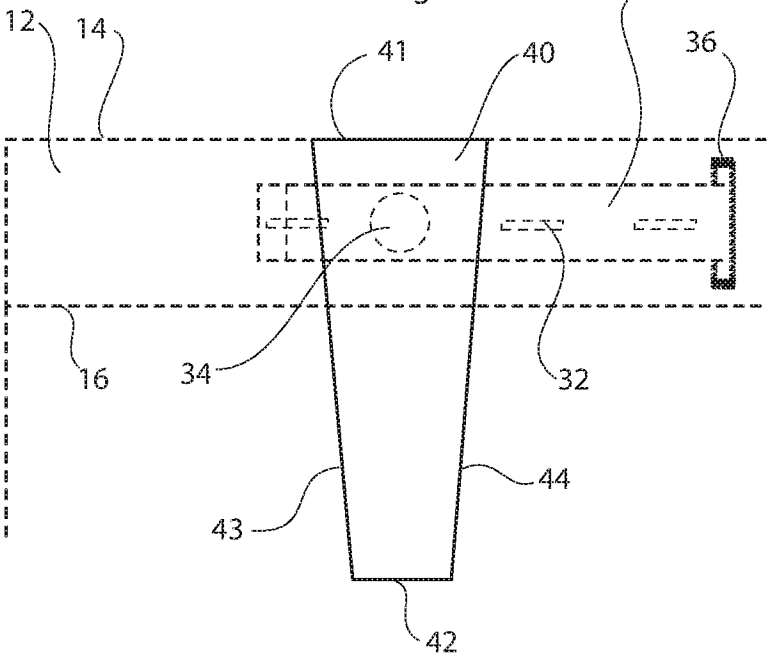
FIG. 11 is another example of a front inside-out inner view of the other side of a bottom garment to FIG. 10, showing a garment cover for adjustment fit attachment.
Figure 10:
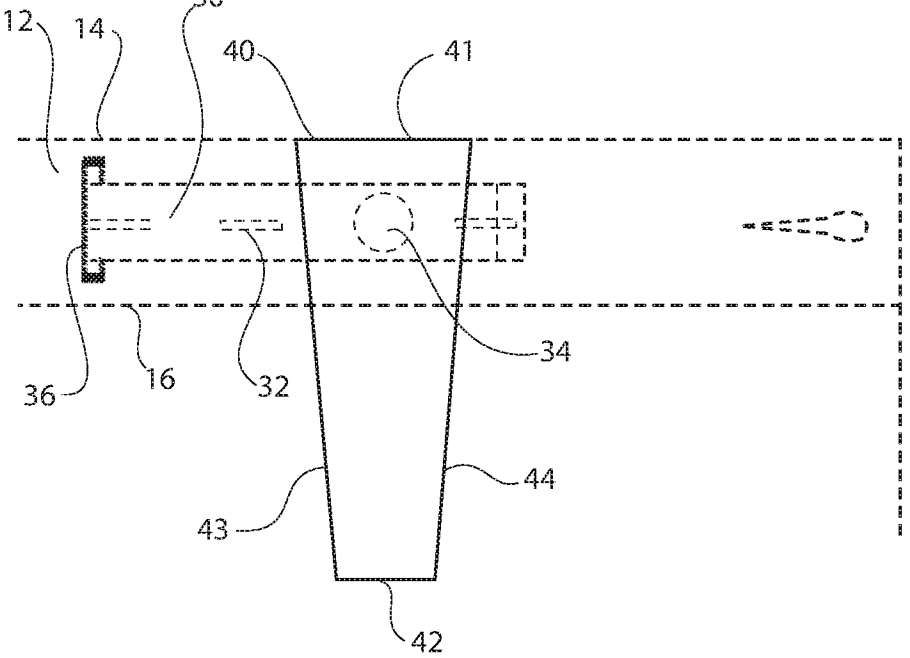
FIG. 10 is another example of front inside-out inner view of one side of a bottom garment showing a garment cover for adjustment fit attachment according to the present disclosure.
Figure 13:
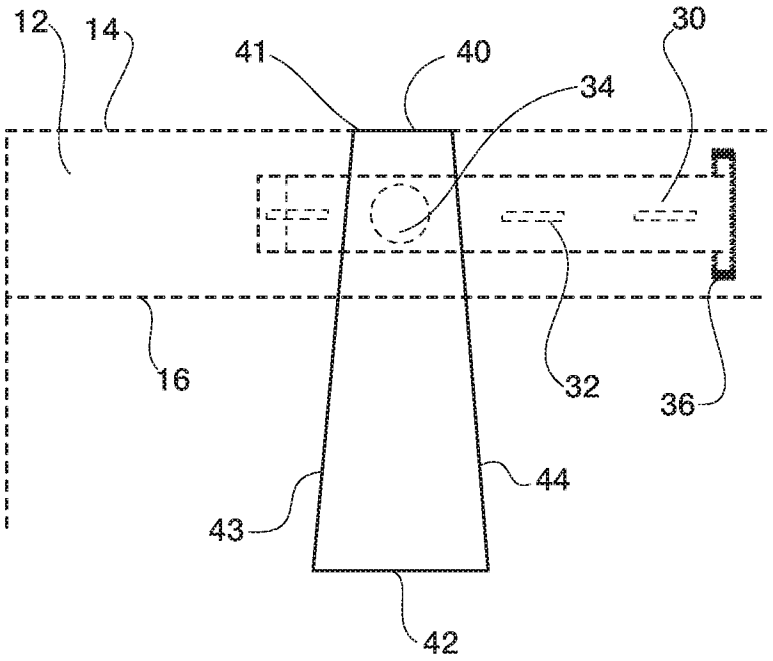
FIG. 13 is another example of a front inside-out inner view of the other side of a bottom garment to FIG. 12, showing a garment cover for adjustment fit attachment.
Figure 12:
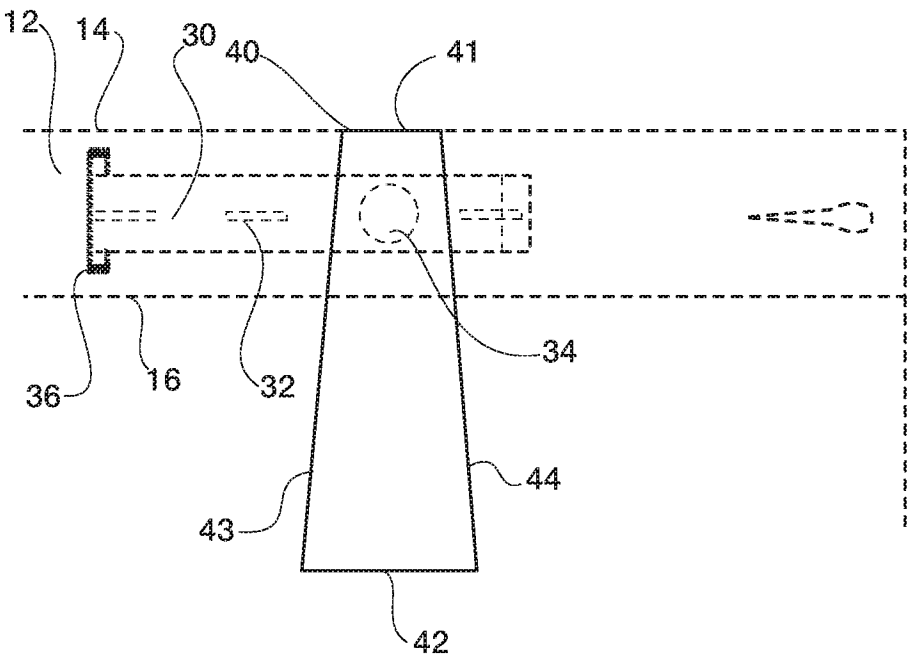
FIG. 12 is another example of front inside-out inner view of one side of a bottom garment showing a garment cover for adjustment fit attachment according to the present disclosure.
Figure 15:
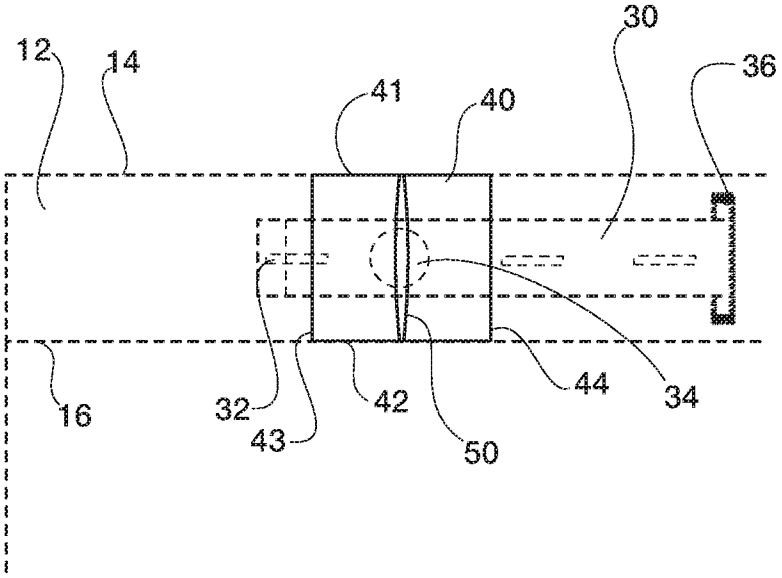
FIG. 15 is another example of a front inside-out inner view of the other side of a bottom garment to FIG. 14, showing a garment cover for adjustment fit attachment.
Figure 14:
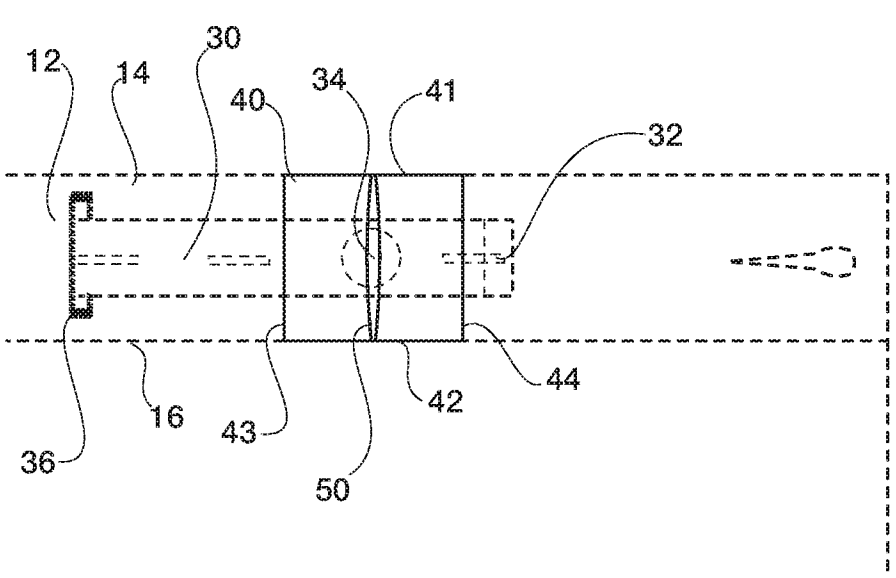
FIG. 14 is another example of front inside-out inner view of one side of a bottom garment showing a garment cover for adjustment fit attachment according to the present disclosure.
Figure 16:
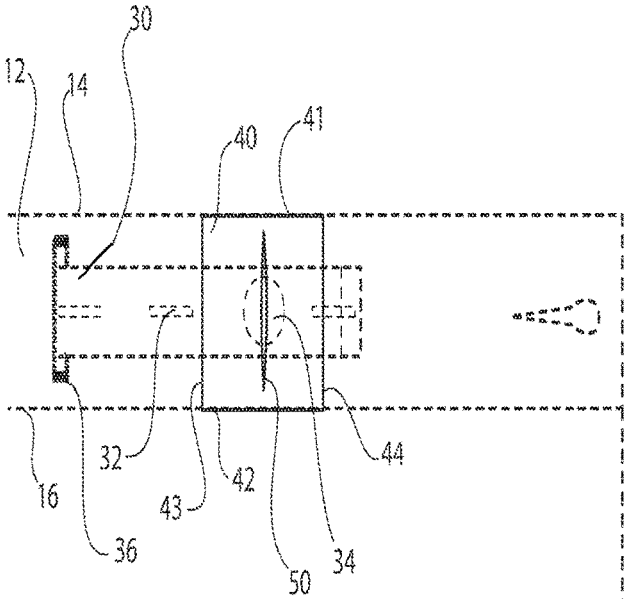
FIG. 16 is another example of front inside-out inner view of one side of a bottom garment showing a garment cover for adjustment fit attachment according to the present disclosure.
Figure 17:
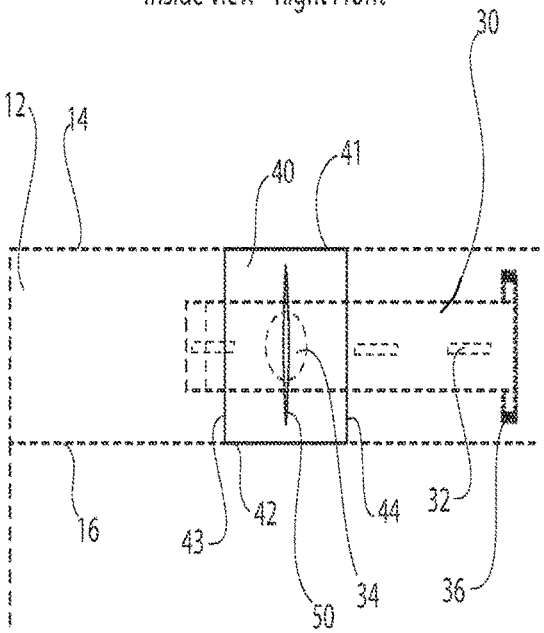
FIG. 17 is another example of a front inside-out inner view of the other side of a bottom garment to FIG. 16, showing a garment cover for adjustment fit attachment.
Figure 19:
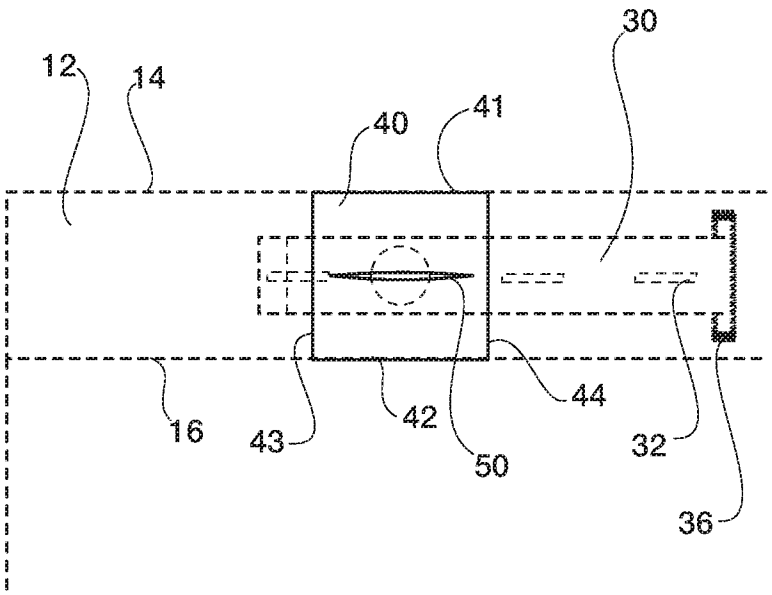
FIG. 19 is another example of a front inside-out inner view of the other side of a bottom garment to FIG. 18, showing a garment cover for adjustment fit attachment.
Figure 18:
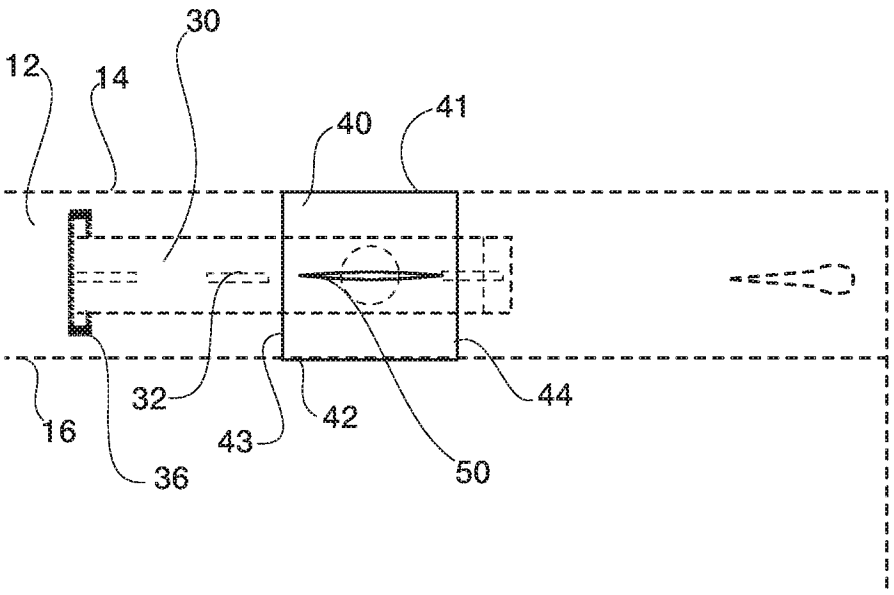
FIG. 18 is another example of front inside-out inner view of one side of a bottom garment showing a garment cover for adjustment fit attachment according to the present disclosure.

FIGS. 4 through 19 show other embodiments of cover 40, which may take on a variety of variable shapes. In some examples, cover 40 includes an attachment point below the lower waistband 16, by way of example as in FIGS. 4-5. In other examples, cover 40 may include a cover first side 43 and cover second side 44 that are non-parallel sides as in FIGS. 6-13. In other examples, cover 40 includes a mid-access point 50 between first side 43 and the second side 44 of the cover 40, examples as shown in FIGS. 14-19.

The cover 40 may include a greater flexibility in a plane between the first side 43 and the second side 44 than along a plane between the cover top 41 and the cover bottom 42.

The cover 40 may be a retractable fabric such that the cover 40 may be manipulated to be pulled back in a second position to reveal the adjustment fit attachment 34 so that the adjustment assembly may be adjusted for sizing along the adjustment fit band 30. The cover 40 may be a durable material that is able to withstand multiple washings and usage, especially in a children's garment. The material may be fire retardant.

The cover 40 may be a resilient cover. At least a portion of the cover 40 may be retractable to reveal the adjustment fit attachment 34, and after a sizing adjustment is made, the cover, in this example, is resilient, such that the cover 40 returns substantially to a first position, covering the adjustment fit attachment 34.

In some embodiments, a stretch of the cover 40 is greater in a horizontal direction than in a vertical direction.

The garment cover 40 may be formed of a knitted fabric. The knitted fabric, in some examples, is a circular knit fabric. In other examples, the knitted fabric is an interlock circular knit fabric. The knitted fabric may also be a synthetic yarn fabric. The knitted fabric may be a 100% polyester yarn fabric.

In some examples, the stretch in the weft direction (horizontal) of the garment cover 40 may be greater than a stretch in the weft direction (horizontal) of the garment. The stretch of the cover 40 in a horizontal direction may be greater than a stretch of the cover 40 in the vertical direction. The stretch in the weft direction of the garment cover 40 may be greater than a stretch in the warp direction of the cover 40.

Figure 20:
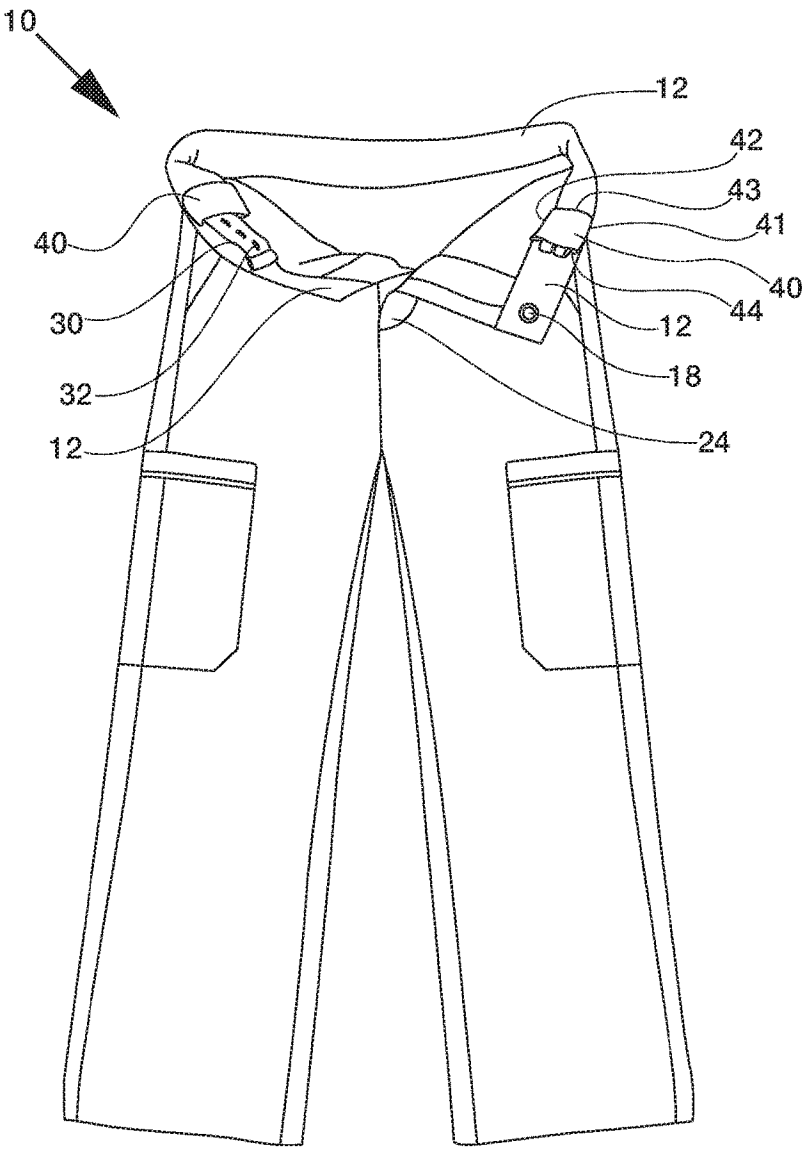
FIG. 20 is another example of a front external view of a garment with a front portion of the garment at the waistband turned down to show the inside of the garment at the garment cover for an adjustment fit attachment constructed according to one embodiment of the present disclosure.
Figure 21:
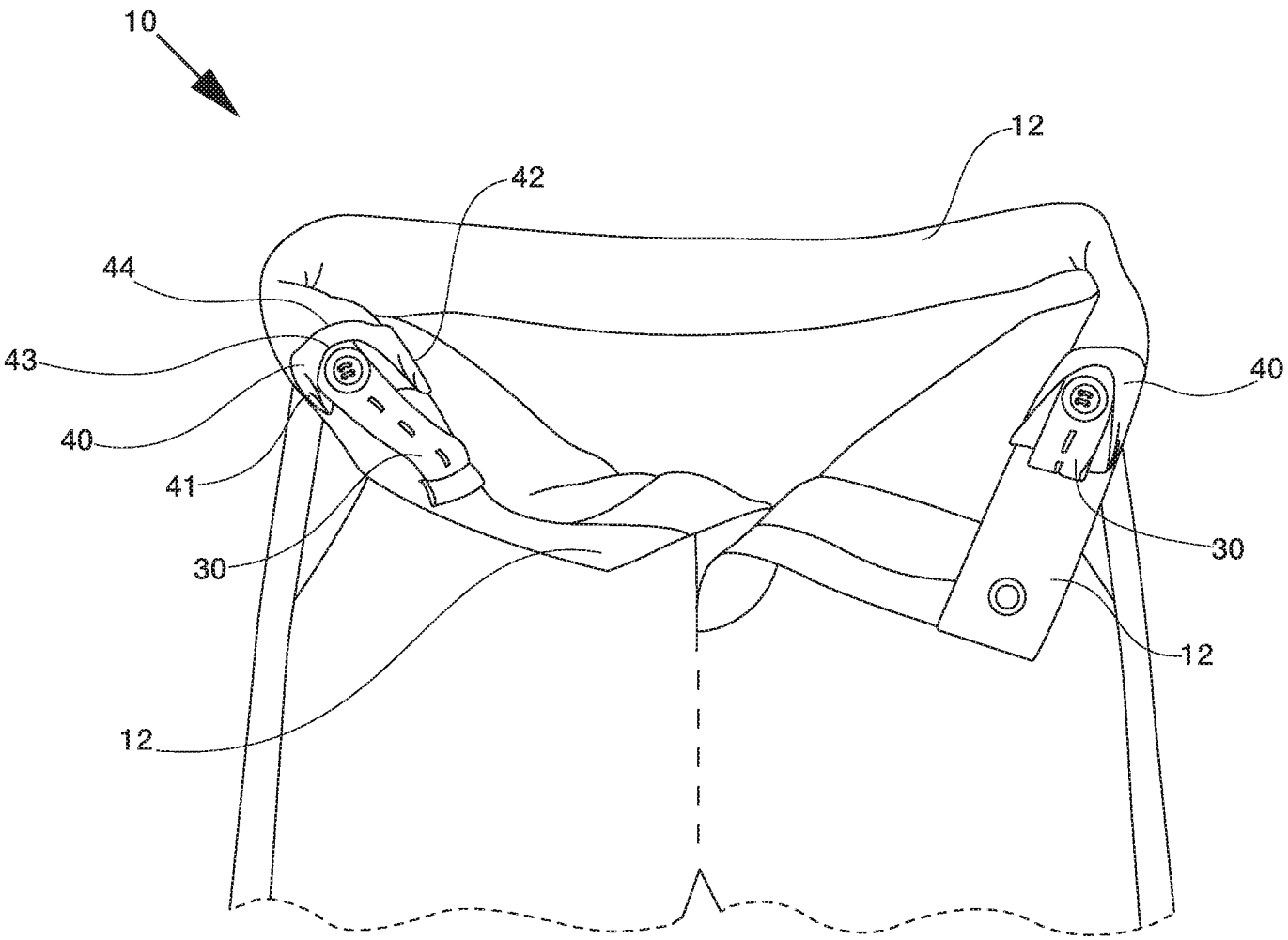
FIG. 21 is a magnified front outer view of the bottom garment of FIG. 20, showing the garment cover for an adjustment fit attachment in a second retracted, resilient position.

FIG. 20 shows a garment 10 with a cover 40 in a first position covering a fit adjustment attachment 34. FIG. 21 shows a garment 10 with a cover 40 in a second position where the cover is retractable to reveal the fit adjustment attachment 34 to allow for sizing adjustment of the garment.

Figure 22:
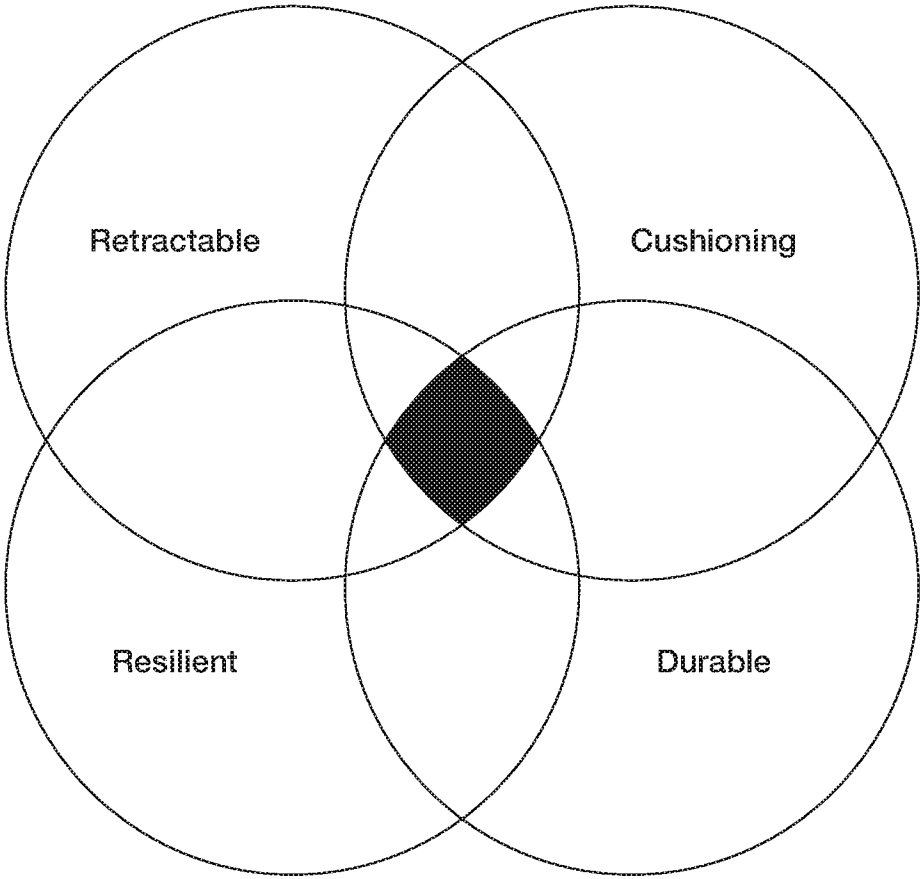
FIG. 22 is a graphical representation of a garment cover for an adjustment fit button formed of a retractable, resilient, wear resistant, and cushion fabric formed of a high weft-stretch, low weight fabric where the stretch in the weft direction of the garment covering is greater than the stretch in the weft direction of the garment panel.

FIG. 22 shows a graphical representation of a garment cover for an adjustment fit button formed of a retractable, resilient, wear resistant, and cushion fabric formed of a high weft-stretch, low weight fabric covering where the stretch in the weft direction of the garment cover 40 is greater than the stretch in the weft direction of the panel.

In some embodiments, the cover 40 may be a loop attached to the garment. The loop may be elongated. The loop, in this example, may form a loop which is larger than the depth of the cover where attached 41, 42. The loop may attach at 41, 42 and may be longer than a length between 41, 42. The cover 40 at the top end at 41 and the bottom end at 42 may fold back upon the cover 40 forming folded ends and may be attached by way of the folded ends, configuring a loop cover that is set apart from the garment by the folded ends, one example as shown in FIG. 20. The loop may be a continuous loop. The loop may occur along any portion of the waistband 12.

Embodiments may include an adjustment fit band 30 and an adjustment fit attachment 34. The adjustment fit band 30 may extend along the waistband 12. The adjustment fit band 30 may include an elastic portion. The adjustment fit band 30 may be made of an elastic material that extends from one end to the other end of the adjustment fit band 30. The adjustment fit band 30 may adjoin with a segment having a different elastic property than a main portion of the adjustment fit band. The adjustment fit band 30 may adjoin with a segment that is substantially non-elastic along the adjustment fit band. The adjustment fit band 30 may extend the full length of the waistband 12 or may not extend the full length of the waistband. The adjustment fit band 30 may be secured to the garment along the front of the waistband 12, the back of the waistband, along the side portions of the waistband, and/or a combination of attachments along the waistband. In some embodiments, the adjustment fit band 30 is partially and/or entirely enclosed within the waistband along an internal tunnel formed on an inside face of the waistband. The tunnel may be formed by an outside and inside wall of the waistband 12. The outside and inside wall may be of the same or different materials. The tunnel may extend mainly around the back of the garment waistband, the back and sides of the waistband, and/or, by way of example, only terminate along a front portion of the waistband 12, exposing the adjustment fit band 30. The adjustment fit band 30 may be covered by the tunnel, extend from the tunnel and then be enclosed within the waistband 12 and the cover 40 along another section of the band 30.

The adjustment fit attachment 34, may include one or more attachments. By way of example, the adjustment fit attachments may be a button, a snap, a hook, an eye, etc. The adjustment fit slots 32, may include one or more slots and may connect with the adjustment fit attachment to secure the adjustment fit band 30 along the waistband 12 and/or along the waistband at a point where the adjustment fit cover 40 is located. By way of example, the adjustment fit slots may be an opening, a button, a snap, a hook, an eye, a slot, etc.

Some embodiments may be considered a garment 10 having a covering system according to any of the embodiments disclosed herein.

Other embodiments include a garment cover assembly according to any of the embodiments disclosed herein.

Still other examples include, a method for a garment cover 40 for an adjustment fit assembly according to any of the embodiments disclosed herein.

Certain modifications and improvements will occur to those skilled in the art upon a reading of the foregoing description. By way of example, while one embodiment shown in the above disclosure illustrates a bottom garment that may include jeans, pants, culottes and shorts, it should be clear that the inventions of the present disclosure may be modified, as disclosed, to further include a garment cover in garments include skirts and top garments, such as, shirts, vests and jackets. By way of example, the cover 40 may be a fabric that reduces the friction between the skin and the fit adjustment attachment. It should be understood that all such modifications and improvements have been deleted herein for the sake of conciseness and readability but are properly within the scope of the following claims.

I claim:

1. A garment for providing comfort to a wearer, said garment comprising:

(a) a waistband having an inside surface, an upper waistband, and a lower waistband, the inside surface forming an innermost surface of the waistband that is configured to face and extend entirely around the wearer;

(b) an adjustment fit assembly including:

an adjustment fit band, an adjustment fit attachment attached directly to and extending inward from the inside surface of the waistband, a set of fit adjustment slots in the adjustment fit band, and a waistband fit band opening, and (c) a garment cover for the adjustment fit attachment, the garment cover having a top edge and a bottom edge, the top edge attached directly to the inside surface of the waistband or an inside surface of the garment, the bottom edge attached directly to the inside surface of the waistband or the inside surface of the garment.

2. The garment according to claim 1, wherein said cover is configured to provide a lining between the adjustment fit attachment and the wearer.

3. The garment according to claim 2, wherein said cover is a resilient fabric.

4. The garment according to claim 1, wherein said cover is a cushion cover fabric providing a cushion between the adjustment fit attachment and the wearer.

5. The garment according to claim 4, wherein said cover is a wear resistant fabric.

6. The garment according to claim 5, wherein said cover is a retractable fabric.

7. The garment according to claim 1, wherein the top edge of the cover is attached directly along the upper waistband of the garment.

8. The garment according to claim 7, wherein the bottom edge of the cover is attached directly along the lower waistband of the garment.

9. The garment according to claim 8, wherein said cover includes an attachment point along a side edge of the cover, forming a perpendicular attachment vertically between the upper waistband and the lower waistband across the waistband.

10. The garment according to claim 7, wherein the bottom edge of the cover is attached directly to the inside surface of the garment below the lower waistband.

11. The garment according to claim 1, wherein the waistband includes the waistband fit band opening defined therethrough, at least a portion of the adjustment fit band extending through the waistband fit band opening, the adjustment fit band including an exposed portion protruding from the waistband fit band opening such that the adjustment fit band is exposed along the inside surface of the waistband, and wherein the adjustment fit band is configured to tighten and loosen the waistband of the garment by being adjusted substantially horizontally along the waistband and secured at an adjustment point by way of the adjustment fit attachment.

12. The garment according to claim 11, wherein at least a part of the exposed portion of the adjustment fit band is covered by the cover.

13. The garment according to claim 12, wherein said cover includes a first covering position and a second retracted position in which the cover is configured to be retracted back along a first side edge of the cover to expose the adjustment fit attachment.

14. The garment according to claim 13, wherein the cover is resilient such that once the cover is released from the second retracted position, the cover returns to the first covering position to cover the adjustment fit attachment.

15. The garment according to claim 14, wherein the first side edge and a second side edge of the cover are non-parallel with one another.

16. The garment according to claim 14, wherein said cover includes a mid-access point between the first side edge and a second side edge thereof.

17. The garment according to claim 1, wherein said cover includes a greater flexibility in a plane between a first side edge and a second side edge than along a plane between the top edge and the bottom edge.

18. The garment according to claim 1, wherein stretch of said cover is greater in a horizontal direction than in a vertical direction.

19. A garment for providing comfort to a wearer, the garment comprising:

a waistband having an inside surface configured to face the wearer and to form an innermost surface of the waistband that extends entirely around the wearer;

an adjustment fit assembly comprising:

a waistband fit band opening defined through the waistband;

an adjustment fit band, at least a portion of the adjustment fit band extending through the waistband fit band opening, the adjustment fit band including an exposed portion protruding from the waistband fit band opening such that the adjustment fit band is exposed along the inside surface of the waistband;

an adjustment fit attachment attached to and extending inward from the inside surface of the waistband;

a set of fit adjustment slots in the adjustment fit band; and a garment cover having a top edge and a bottom edge, the top edge attached to the inside surface of the waistband or an inside surface of the garment, the bottom edge attached to the inside surface of the waistband or the inside surface of the garment.

* * * * *